US011286896B2

(12) United States Patent
Geyer et al.

(10) Patent No.: US 11,286,896 B2
(45) Date of Patent: Mar. 29, 2022

(54) TAPPET FOR A FUEL PUMP OR FOR A VALVE DRIVE

(71) Applicant: Schaeffler Technologies AG & Co. KG, Herzogenaurach (DE)

(72) Inventors: Norbert Geyer, Höchstadt (DE); Franz Huschka, Höchstadt/Aisch (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/262,820

(22) PCT Filed: May 17, 2019

(86) PCT No.: PCT/DE2019/100446

§ 371 (c)(1),
(2) Date: Jan. 25, 2021

(87) PCT Pub. No.: WO2020/038513

PCT Pub. Date: Feb. 27, 2020

(65) Prior Publication Data

US 2021/0222658 A1 Jul. 22, 2021

(30) Foreign Application Priority Data

Aug. 21, 2018 (DE) ..... 10 2018 120 265.2

(51) Int. Cl.
*F01L 1/14* (2006.01)
*F02M 59/10* (2006.01)

(52) U.S. Cl.
CPC ..... *F02M 59/102* (2013.01); *F01L 1/14* (2013.01); *F01L 2305/02* (2020.05)

(58) Field of Classification Search
CPC ..... F01L 1/14; F01L 1/143; F02M 59/102
USPC ..... 123/90.48
See application file for complete search history.

(56) References Cited

U.S. PATENT DOCUMENTS

| | | | | |
|---|---|---|---|---|
| 3,990,413 | A | 11/1976 | Pischinger | |
| 4,234,292 | A | 11/1980 | Berg | |
| 6,209,498 | B1 * | 4/2001 | Brothers | F01L 1/14 123/90.5 |
| 2020/0032678 | A1 | 1/2020 | Geyer | |
| 2020/0095901 | A1 | 3/2020 | Geyer et al. | |
| 2020/0263645 | A1 | 8/2020 | Hußenether et al. | |

FOREIGN PATENT DOCUMENTS

| | | | |
|---|---|---|---|
| AT | 306442 | B | 4/1973 |
| CN | 102686835 | A | 9/2012 |
| DE | 2309916 | A1 | 10/1974 |
| DE | 2723969 | A1 | 11/1978 |
| DE | 102013204178 | A1 | 9/2014 |
| DE | 102014218961 | A1 | 3/2016 |
| DE | 102017109761 | A1 | 11/2018 |
| EP | 3173591 | A1 | 5/2017 |

(Continued)

*Primary Examiner* — Jorge L Leon, Jr.
(74) *Attorney, Agent, or Firm* — Matthew Evans

(57) ABSTRACT

The disclosure proposes a tappet with a housing which is composed of a drive-side and an output-side section. The drive-side section, at its outer end, has a roller and the output-side section, at its outer end, has a contact area for a follower part. The separate sections are axially spaced apart from one another and are connected to one another by a central rod piece.

16 Claims, 2 Drawing Sheets

(56) References Cited

FOREIGN PATENT DOCUMENTS

| | | | |
|---|---|---|---|
| JP | S57134358 | U | 8/1982 |
| JP | S5934040 | U | 3/1984 |
| JP | 612305 | Y2 | 1/1986 |

* cited by examiner

TAPPET FOR A FUEL PUMP OR FOR A VALVE DRIVE

CROSS-REFERENCE TO RELATED APPLICATIONS

This application is the U.S. National Phase of PCT Application No. PCT/DE2019/100446 filed on May 17, 2019 which claims priority to DE 10 2018 120 265.2 filed on Aug. 21, 2018, the entire disclosures of which are incorporated by reference herein.

TECHNICAL FIELD

This disclosure relates to a tappet, in particular for a fuel pump or for a valve drive, in each case of an internal combustion engine.

BACKGROUND

A two-part tappet, here a pump tappet, emerges from DE 10 2014 218 961 A1. Its housing sections are each annular and plugged together in the region of their inner ends facing one another. The drive-side section carries a roller. The output-side section has a base facing the drive-side section, the free under side of which has a contact area for a follower part, here a pump piston or the like.

It has been found that this tappet is hardly suitable for long installation lengths, as is nowadays found in modern internal combustion engines, for example also in the course of an arrangement of the pump cam or eccentric on a cam, intermediate or crankshaft. An "installation length" is to be understood as a distance between a driving cam or eccentric and the tappet follower part such as the pump piston. The housing heights required for this cannot be produced or cannot be produced economically by simply deep drawing (sheet metal) or stamping or forging in the die, especially since the tappet would then be too large. In addition, there is a risk that the two-part housing will be deformed when plugged together in the edge area, which would impair its necessarily high-precision guidance.

A tappet with a one-piece housing made from an extruded profile piece emerges from DE 10 2013 204 178 A1. DE 10 2017 109 761, which was not previously published, discloses a tappet composed of a total of three components.

SUMMARY

The object is to create a tappet as mentioned above, which is well suited for long installation lengths and is easy to build and can be produced economically.

According to the disclosure, this object is achieved in that the separate sections are axially spaced apart from one another and are connected to one another by a central rod piece.

The disadvantages described above are thus eliminated. The tappet can be built significantly higher or longer than the variants previously embodied. Its housing parts (sections) can be easily assembled and finely machined (grinding) on their respective outer shells in one go. The rod piece connecting the two sections according can be designed with a comparatively very small thickness, so that the "long tappet" has only an insignificantly greater weight than shorter standard tappets. The rod piece can be a solid or hollow component and possibly also have a polygonal cross-section. The tappet, as described herein, can function with comparatively little tilt in its pump or cylinder head guide. The sections can also possibly have different diameters from one another. The tappet guide would then also have to be stepped.

In an example embodiment, a central extension starts from each of the sections in the direction of the respective other section, which extensions are then connected in the region of their adjoining terminal ends in order to form the rod piece lying therebetween. The extensions can be formed integrally from the base of the respective extension, for example during extrusion or stamping of the respective entire section. However, they can also be provided as separate components that are subsequently joined to the respective section. It is also conceivable and provided to have the rod-like extension protrude away from only one of the separate sections, so that this is then attached to the base of the other section via its free terminal end. A separate rod piece can also be joined to the bases of the sections.

Instead of the aforementioned extrusion or stamping of at least one of the two sections, a sheet metal design is also envisaged, wherein the rod section can be provided separately for the case in which both sections are drawn from sheet metal.

A great advantage of the disclosure is that with standardized sections, which can be obtained from slightly modified cup tappets or pump tappet base bodies, and by using rod pieces of variable length, pumps or valve drives of a wide range of internal combustion engine types can be operated inexpensively. For the representation of the above-mentioned base body, it can be advantageous to use tappets available as mass-produced articles from the modular system; this includes minor subsequent modifications.

If two extensions are provided, welding such as friction welding is a suitable joining process. A plug connection is also possible, in which an end section of an extension is seated in a pocket of the other section and is possibly subsequently clamped or welded. It is also conceivable to guide a sleeve or the like over the separation point between the extensions.

According to further details of the disclosure, the extension on the drive-side section should start from an outer side and that of the output-side section should start from an inner side of the respective base. A reversal of the above or a protrusion of the extensions equally from the inner side or the outer side of the bases would also be conceivable. However, the drive-side section extension protruding from the inside of its base is only reasonably feasible if a sliding surface is applied instead of the roller.

A simple measure of fastening the roller in the drive-side section is also provided. Accordingly, this section can have two opposing flat surfaces, each with a bore, in which a roller axle is received, at its outer end, or slightly indented therefrom. Depending on the application, a sliding or rolling bearing of the roller, possibly also with an intermediate ring, is provided on the axle.

Guide height and thus material and mass on the drive-side section is thus saved if the bores for the axle in the flat surface are seated in roof-like, raised segments opposite the outer end. The drive-side section can also possibly be continuously cylindrical and have suitable bridging pieces for fastening the axle in its interior.

BRIEF DESCRIPTION OF THE DRAWINGS

The disclosure is explained with reference to the figures. In the figures.

DETAILED DESCRIPTION OF THE EMBODIMENTS

Figure 1:
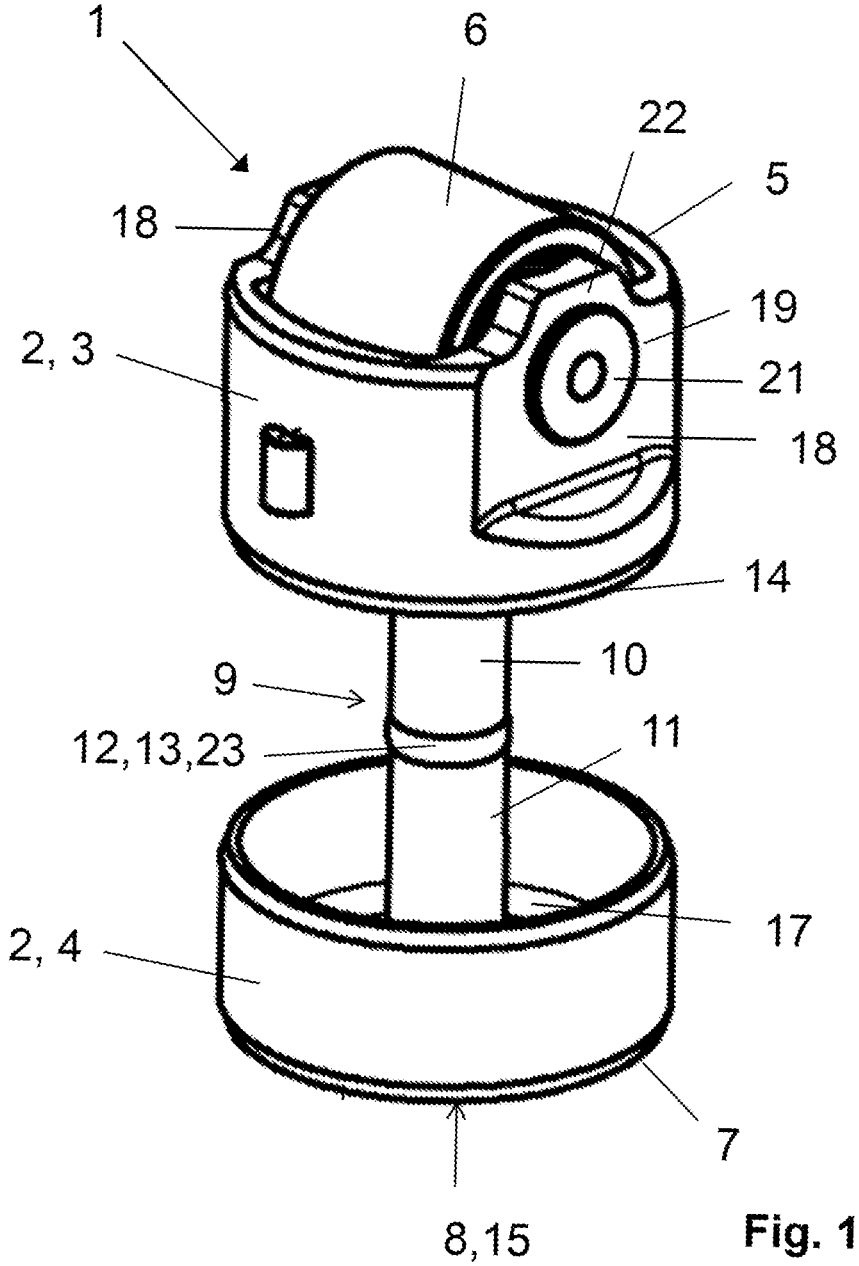
FIG. 1 shows a spatial view of a tappet for a high-pressure fuel pump.

A tappet 1 for a high-pressure fuel pump of an internal combustion engine is shown. The tappet 1 has a two-part, built-up housing 2. This consists of a drive-side and an output-side section 3, 4 of the same external diameter. Both sections 3, 4 are designed as cup-shaped hollow bodies. The upper, drive-side section 3 is essentially formed from a standard pump tappet body. The lower, output-side section 4, on the other hand, is shown as a standard cup tappet body shortened in height, as is used in directly actuated valve drives. Both sections 3, 4 are open in the same direction upwards, i.e., in the cam or drive direction.

Figure 3:
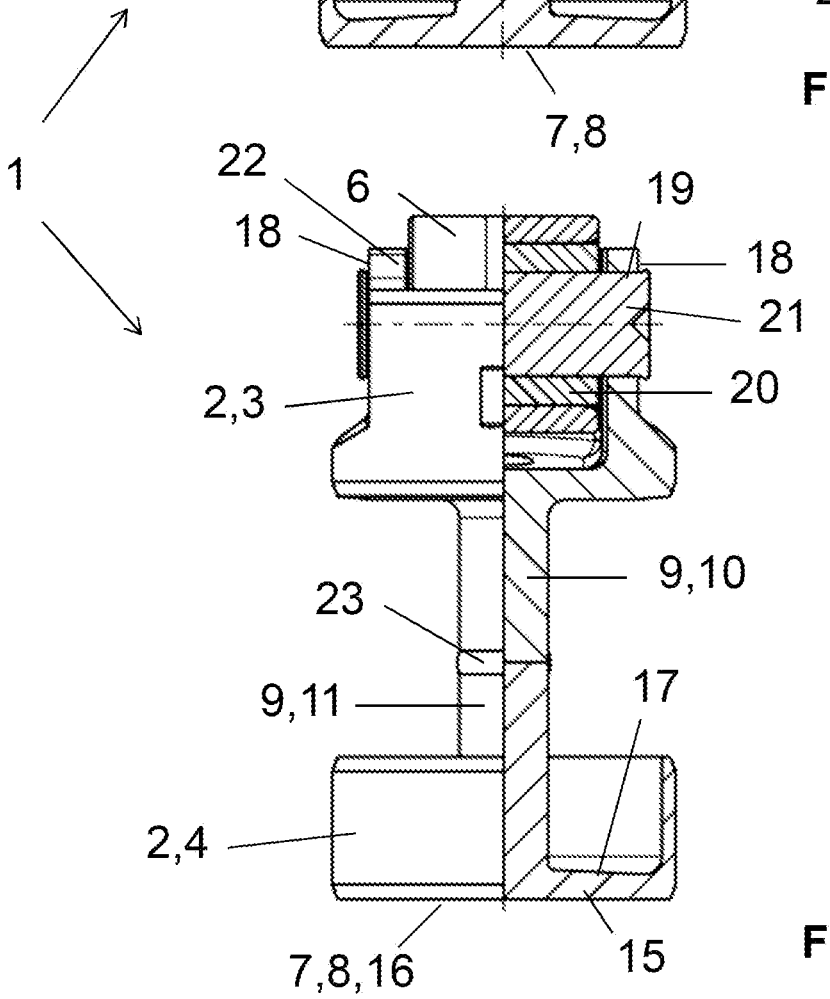

At its outer end 5, the drive-side section 3 has a roller 6 mounted on an axle 21 via a rolling bearing 20 (needle bearing). At the end, the axle 21 is seated in bores 19 of flat surfaces 18. These start from an outer end 5 of the drive-side section 3 and, as disclosed in FIG. 3, extend over more than half the height of a guide shroud 25 of the drive-side section 3. FIG. 1 best shows that each of the above-mentioned flat surfaces 18 runs in a segment 22 raised like a roof in relation to the outer end 5 of the drive-side section 3, in which segment 22 the respective bore 19 is located in sections.

The output-side section 4 has, at its closed outer end 7, which thus lies on its base 15, a contact area 8 for a pump piston as a follower part.

As can be seen, the separate sections 3, 4 are clearly spaced apart from one another axially and are connected to one another by a central rod piece 9.

This rod piece 9 is composed of two extensions 10, 11. The integrally connected rod-like extension 10 extends from the base 14 of the upper section 3 in the direction of the lower section 4. At the same time, from an inner side 17 of a base 15 of the lower section 4, an integrally formed, likewise rod-like extension 11 extends through the latter. The extensions 10, 11 are connected by a welding 23 in the region of their adjoining terminal ends 12, 13.

The tappet 1 is ideal for long installation lengths; here with pump drives. Guide shrouds 25, 26 of its sections 3, 4 have the same outer diameter and can be ground in one go.

Figure 2:
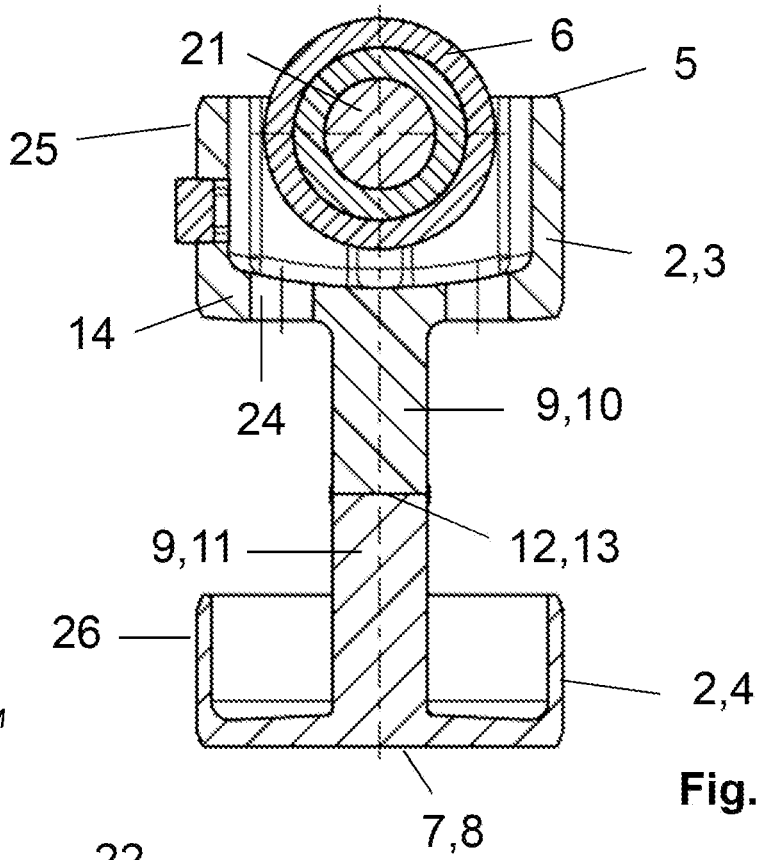
FIG. 2 shows a longitudinal section through the above-mentioned tappet; and, FIG. 3 shows a longitudinal section as mentioned above, but rotated by 90°.

In FIG. 2, through-openings 24 are also shown in the base 14 of the drive-side section 3. These provide an unhindered passage of oil or fuel or air (here the keyword is: "prevention of inflation") and can also lie in the base 15 of the output-side section 4.

LIST OF REFERENCE SYMBOLS

1 Tappet
2 Housing
3 Drive-side section
4 Output-side section
5 Outer end
6 Roller
7 Outer end
8 Contact area
9 Rod piece
10 Drive-side section extension
11 Output-side section extension
12 Terminal end
13 Terminal end
14 Drive-side section base
15 Output-side section base
16 Outer side
17 Inner side
18 Flat surface
19 Bore
20 Rolling bearing
21 Axle
22 Segment
23 Welding
24 Through-opening
25 Guide shroud
26 Guide shroud

The invention claimed is:

1. A tappet of an internal combustion engine, the tappet comprising:
- a housing including:
  - a drive-side section having:
    - a first external diameter; and
    - a first outer end having a roller; and
  - an output-side section axially spaced from the drive-side section, the output-side section having:
    - a second external diameter equal to the first external diameter; and
    - a second outer end having a contact area configured to engage a follower,
  - wherein the drive-side section and the output-side section are connected to one another via a central rod, and
  - wherein the central rod includes a first central rod extension and a second central rod extension respectively protruding from the drive-side section and the output-side section such that a first end face of the first central rod extension is joined with a second end face of the second central rod extension.

2. The tappet of claim 1, wherein the drive-side section is formed as a cup-shaped hollow body having a base and an outer end, the base facing away from the outer end, and the first central rod extension extends from the base.

3. The tappet of claim 1, wherein the output-side section is formed as a cup-shaped hollow body having a base, an outer side of the base having a contact surface configured for contacting the follower, wherein the second central rod extension extends from an inner side of the base.

4. The tappet of claim 1, wherein the first end face is joined with the second end face via a weld.

5. The tappet of claim 1, wherein the drive-side section has two diametrically opposed flat surfaces, each flat surface having a bore configured to receive an axle supporting a rolling or sliding bearing of the roller.

6. The tappet of claim 5, wherein each flat surface extends in the second direction so as to form a roof above the first outer end.

7. The tappet of claim 1, wherein at least one of the drive-side or output-side sections is manufactured from sheet steel.

8. The tappet of claim 1, wherein the first central rod extension is formed integrally with a base of the drive-side section.

9. The tappet of claim 1, wherein the second central rod extension extends from an inner side of a base of the output-side section and through an open inner end of the output-side section.

10. A tappet of an internal combustion engine, the tappet comprising:
- a housing having:

a drive-side section including a first guide shroud having a first outer diameter;

an output-side section including a second guide shroud axially spaced from the first guide shroud, the second guide shroud having a second outer diameter equal to the first outer diameter; and a central rod configured to connect the drive-side section to the output-side section, the central rod extending from a first base of the drive-side section to a second base of the output-side section, wherein the drive-side section is shaped as a first cup-shaped hollow body including a first closed end defining the first base, wherein the output-side section is shaped as a second cup-shaped hollow body including a second closed end defining the second base, and wherein the first and second cup-shaped hollow bodies open in a same direction.

11. The tappet of claim 10, wherein the first base includes through-openings configured to convey a fluid.

12. The tappet of claim 10, wherein the central rod comprises a first central rod extension and a second central rod extension respectively extending from the first base and the second base.

13. The tappet of claim 12, wherein the first central rod extension is joined with the second central rod extension via a weld.

14. The tappet of claim 10, wherein a longitudinal length of the central rod is greater than a diameter of the central rod.

15. A tappet of an internal combustion engine, the tappet comprising:

a housing having:

a first cup-shaped hollow body opening in a first direction;

a second cup-shaped hollow body opening in the first direction, the second cup-shaped hollow body axially spaced from the first cup-shaped hollow body; and a central rod configured to connect a first base of the first cup-shaped hollow body to a second base of the second cup-shaped hollow body.

16. The tappet of claim 15, wherein the first cup-shaped hollow body has a first guide shroud with a first axial length, and the second cup-shaped hollow body has a second guide shroud with a second axial length, and wherein an axial length of the central rod is greater than the first axial length and the second axial length.

* * * * *